United States Patent [19]

Frankiewicz

[11] 4,110,106

[45] Aug. 29, 1978

[54] SELECTIVE SULFATION PROCESS FOR PARTITIONING FERROUS AND NON-FERROUS VALUES IN AN ORE

[75] Inventor: Theodore C. Frankiewicz, Littleton, Mass.

[73] Assignee: Kennecott Copper Corporation, New York, N.Y.

[21] Appl. No.: 836,493

[22] Filed: Sep. 26, 1977

Related U.S. Application Data

[63] Continuation of Ser. No. 657,849, Feb. 13, 1976, abandoned.

[51] Int. Cl.[2] ..... C22B 1/06

[52] U.S. Cl. ..... 75/1 R; 75/101 R; 423/DIG. 12; 423/41; 423/45; 423/49; 423/62; 423/68; 423/146; 423/150

[58] Field of Search ..... 75/1 R, 1 T, 21, 97 R, 75/101 R, 115, 116, 117, 119, 121; 423/DIG. 12, 41, 45, 49, 62, 68, 89, 98, 146, 150, 53

[56] References Cited

U.S. PATENT DOCUMENTS

| | | | |
|---|---|---|---|
| 1,364,804 | 1/1921 | Ramkin | 423/98 |
| 2,719,082 | 9/1955 | Sproule et al. | 75/1 R |
| 2,813,016 | 11/1957 | Thornhill | 75/9 |
| 2,930,687 | 3/1960 | Thornhill et al. | 75/9 |
| 3,232,750 | 2/1966 | Kazimietz | 75/119 |
| 3,367,740 | 2/1968 | Zrbryckyj et al. | 75/101 R |
| 3,451,804 | 6/1969 | Malmstrom et al. | 75/7 |
| 3,880,650 | 4/1975 | Pemsler | 75/117 |

OTHER PUBLICATIONS

Delarue, G.; Chime Analytique, vol, 44, No. 3, 3/62, pp. 91–102.

Flood, H.; "The Acidic and Basic Properties of Oxides", Acta Chemica, Scandinavica, vol. 1, (1947), pp. 781–789.

Zubryckyj, N., et al.; "Preferential Sulfation of Nickel and Cobalt in Lateritic Ores", Journals of Metals; (5/65) pp. 478–486.

Weast, R. C. ed., Handbook of Chemistry and Physics 52 ed.; The Chemical Rubber Co., Cleveland, Ohio. p. B62,140 QD65C4 (1971).

Hodgman C. D. ed., Handbook of Chemistry and Physics 43rd ed.; The Chemical Rubber Co. pp. 519, 604, 605 (1961).

*Primary Examiner*—R. Dean

*Assistant Examiner*—Michael L. Lewis

*Attorney, Agent, or Firm*—John L. Sniado; Anthony M. Lorusso

[57] ABSTRACT

Process for quantitatively converting non-ferrous metals chosen from the group consisting of copper, nickel, cobalt, vanadium, and manganese in an ore concentrate to soluble sulfates and simultaneously convert the ferrous values in the ore to insoluble oxides. The process comprises roasting finely divided ore particles at a temperature in excess of 650° C in the presence of a roaster gas comprising at least a stoichiometric amount of oxygen and at least 1% $SO_2$. The roasting is performed in the presence of a sufficient amount of a mixture of salts to allow the formation of a liquid coating on the ore particles. In a preferred embodiment, the mixed salt which forms the liquid coating comprises $Na_2SO_4$ and $K_2SO_4$ with the ratio of sodium to potassium being between 1.0 and 2.0.

28 Claims, 3 Drawing Figures

SELECTIVE SULFATION PROCESS FOR PARTITIONING FERROUS AND NON-FERROUS VALUES IN AN ORE

This is a continuation, of application Ser. No. 657,849 Filed Feb. 13, 1976, now abandoned.

BACKGROUND OF THE INVENTION

This invention relates to a method of processing ores containing one or more metal values selected from the group consisting of copper, nickel, cobalt, vanadium, and manganese which are present in the ore in association with iron. The process rapidly and quantitatively separates the non-ferrous metals from the iron. More particularly, the invention relates to an improvement in the process of selective sulfation of such ores to render the non-ferrous metals leachable and the ferrous metals non-leachable.

It is well known that ores containing pentlandite, pyrrhotite, chalcopyrite, cubanite, other sulfides of copper, other sulfates of nickel, small amounts of cobalt, vanadium and manganese, and various mixtures thereof may be treated to yield metal values by selective sulfation. In general, this process involves oxygen roasting the concentrates in the presence of sulfur dioxide or a sulfate salt to produce sulfates from the copper, nickel, and/or non-ferrous metals present and to convert the ferrous metal values to $Fe_2O_3$. Since the sulfates of the non-ferrous values are soluble, after such treatment, it is possible to water leach the mixture, leaving the ferrous values behind and conveniently extracting the non-ferrous values.

While this process has considerable theoretical potential, it has achieved only limited success in large scale commercial use because of several difficulties which make it economically unfeasible. The most basic disadvantage of the sulfation process is that the temperature and the roaster gas composition are difficult to control so that the production of sulfates of the non-ferrous values is maximized. Although the reaction of iron to form iron oxide generally requires a temperature in excess of about 675° C, at such temperatures much of the copper, nickel, etc. may also be oxidized to a non-leachable state. Below about 675° C, much of the iron is converted to sulfate. Unless a high degree of partitioning between the ferrous and non-ferrous metals can be achieved, the water leach extracts an unacceptably high percentage of the ferrous metal values along with the metal values of interest.

The prior art is replete with attempts to improve the yield of water soluble copper values in the sulfation process. For example, U.S. Pat. No. 3,441,403 to R. E. Fredrickson et al. teaches that the yield of soluble copper may be increased by adding gaseous HCl to the roaster gas. In U.S. Pat. No. 2,719,082 to W. K. Sproule et al., a method for producing high grade hematite from nickel, copper, and cobalt containing iron sulfide ores is disclosed which takes advantage of this sulfation process to remove small amounts of non-ferrous metal sulfide contaminates and small amounts of silica, lime, alumina, and magnesia from the ore. This process involves removing the bulk of the contaminates by conventional separation techniques and then roasting the concentrated and partially purified ore under oxidizing conditions to form a permeable iron oxide calcine containing not more than 1% nickel and 0.1% copper. The calcine is then sulfated by heating it between 630°-687° C (1200°-1300° F) with between 2% and 8% by weight sodium sulfate in the presence of a roasting gas comprising between 4 and 6% sulfur dioxide and more than 5% oxygen. This process is said to be capable of rendering "substantially all" of the small amount of copper present and up to 86% of the nickel present water soluble. However, it is taught that these results can only be achieved when the ore has been pretreated to contain the small recited percentages of copper and nickel.

U.S. Pat. No. 3,791,812 to R. L. Frank et al. discloses a process for extracting copper, cobalt, and manganese values from ores as water soluble salts. In this process, a sulfide ore bearing the metal values of interest is mixed with an inorganic chloride to form a mixture containing from about 30–93 weight percent ore and from about 7 to about 70 weight percent inorganic chloride. A charge of the mixture in a gas permeable state is roasted with oxygen at a temperature of about 300° to 425° C and the sulfur dioxide produced is transferred to a second stage roasting zone where the oxides produced in the first zone are converted to sulfates. The primary object of the invention disclosed in this patent is to reduce sulfur dioxide emissions, and no data is presented which indicates that the ferrous metals and non-ferrous metals are efficiently partitioned. In fact, the temperature range disclosed in this patent indicates that a substantial amount of soluble iron sulfate and iron chloride would be produced by the process and that a substantial amount of iron would therefore be leached along with the non-ferrous metals.

In general, it is believed that all the prior art sulfation processes designed to render substantial amounts of non-ferrous metal values in extractable form, yield a non-ferrous metal sulfate which is contaminated by unsuitably large quantities of iron sulfate and generally require a roasting time which is greater than optimal. In contrast, embodiments of the process of this invention yield up to 99% of the copper, 97% of the nickel, 90% of the cobalt, and comparable percentages of other non-ferrous metals while excluding between 96% and 99% of the iron in a short period of time and under conditions of temperature and pressure which are easily regulated.

SUMMARY OF THE INVENTION

In general, the invention provides a process for partitioning non-ferrous metal values from ferrous metal values in a finely divided ore by rendering the non-ferrous metal values water soluble to the essential exclusion of the ferrous metal values. The process comprises coating the ore particles with a mixture of molten salts having a melting point below 650° C and reacting the coated particles at a temperature between 650° and 800° C, in the presence of a roaster gas comprising $SO_2$ and at least a stoichiometric equivalent of $O_2$. In preferred embodiments, the molten salt mixture comprises a mixture of sulfates, preferably sodium and potassium sulfate, and more preferably, a sodium-potassium sulfate mix having a sodium or potassium ratio between 10 and 0.1. During the process, pyrosulfates are produced which help to stabilize the nonferrous metal sulfates, dissolve any ferrites which may have formed, and substantially prevent non-ferrous metal sulfate decomposition. During the course of the roast, sulfides are converted to oxides and the oxides are sulfated. The use of the salt coating in the presence of sulfur dioxide on the order of between 1% and 25%, preferably about 5%, in the roasting gas mixture, allows roasting at temperatures where greater than 96% of the ferrous metal values are converted to insoluble forms. To effectively coat the ore with molten salt, the mass ratio of molten salt to ore should be greater than about 0.05. However, as the salt-ore ratio is increased beyond the preferred range of 0.10 to 0.25, the economic advantages of the process are increasingly lost. The ore or ore concentrate, roaster gas, and molten salt must be intimately mixed during the roasting, and one preferred method of mixing comprises bubbling the roaster gas through the salt-ore mixture. The temperature at which essentially quantitative selective sulfation of non-ferrous values is economically effected is between 650° and 800° C, preferably between 675° and 750° C. During the process, an easily leachable molten solution of the salt mixture and non-ferrous metal sulfates is produced which may be separated from the insoluble residue by conventional techniques.

Accordingly, it is an object of the present invention to rapidly (within 0.25-2 hours) extract copper, nickel, cobalt, etc. from an ore or ore concentrate.

Another object of the invention is to effect a quantitative separation of copper, nickel, and cobalt from iron such that the soluble sulfates produces are four percent or less of the available iron in the ore or ore concentrate being treated in the process.

Still another object of the invention is to achieve concentrate extractions of up to 99% copper, 97% nickel, and 90% cobalt in a relatively short time.

Still another object of the invention is to dissolve ferrites and to recover non-ferrous metal from sulfidic, oxidic, ferritic, silicaceous, or other ore concentrates.

Yet another object of the invention is to provide a process for recovering non-ferrous metal values from a variety of heretofore difficult to treat ore concentrates of various grades.

Yet another object of the invention is to provide such a process having a chemistry which is independent of ore concentrate grade.

Another object of the invention is to provide a selective sulfation process wherein temperature and atmospheric requirements are easily regulated.

Other objects and features of the invention will be apparent to those skilled in the art from the following description of a preferred embodiment and from the drawing.

DESCRIPTION OF THE PREFERRED EMBODIMENTS

Figure 1:
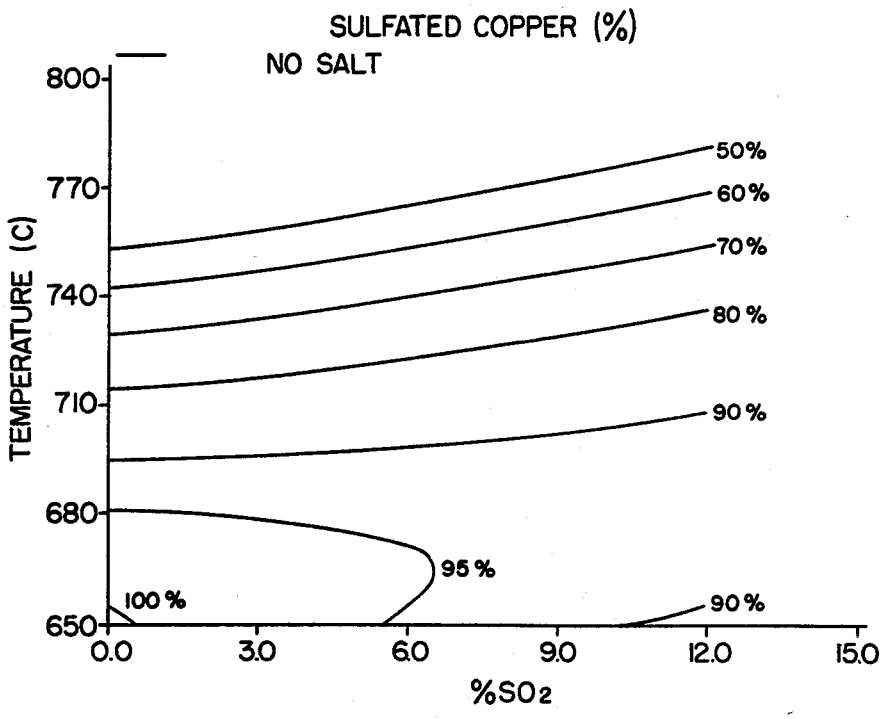
FIG. 1 is a graph showing the results of a series of roasts without a salt coating.

At the outset, the invention is described in its broadest overall aspects with a more detailed description following.

The process of the invention partitions ferrous and non-ferrous metal values in an ore or ore concentrate. The process is characterized by the steps of adding a finely divided ore to a reactor together with a mixture of inorganic salts, intimately mixing the ore and salt mixture, heating the mixture to melt the salt and to cause a coating to form about the ore particles, contacting the ore and salt mixture with $SO_2$ and $O_2$ to produce soluble non-ferrous metal sulfates and insoluble iron oxides, and water quenching the ore and salt mixture to remove the non-ferrous metal sulfates while leaving the iron behind.

The types of ores and ore concentrates with which the present invention is concerned are those in which copper, nickel, cobalt, vanadium, or manganese are found in sulfidic, oxidic, ferritic, or silicaceous states mixed with, inter alia, iron sulfides, oxides, or silicates and ores containing compounds of these metals with iron. While the following description and examples will deal essentially with copper and nickel, it will be apparent to those skilled in the art, that since cobalt, vanadium, and manganese are chemically similar to copper and nickel, these metals can be treated in accordance with the invention with little or no modification of the process. Minerals which are particularly well-adapted for treatment in accordance with the process of the invention include pendlandite, pyrrhotite, chalcopyrite, and cubanite. Frequently, trace amounts of sulfidic or oxidic salts of cobalt, vanadium, and/or manganese are found mixed with such minerals, and it is contemplated that, when desired, these minerals may be recovered together with the copper and nickel.

Since, as disclosed below, the chemistry of the process is independent of the concentrate grade, the process of the present invention is operable with a wide range of concentrate grades which may be made by conventional techniques. In any industrial use of the process, some form of concentrate is highly preferred over the raw ore.

In the process of the invention, the ore in finely divided form is placed in a rotary kiln, fluid bed, or other suitable reactor together with a mixture of salts, preferably a mixture of sodium and potassium sulfate. A sufficient amount of the salt mixture should be added to provide at least a thin coating of salt on the ore particles. The ratio of salt to concentrate affects the recovery of both copper and nickel with the larger effect being on nickel recovery. Generally, the mass ratio of salt to concentrate should lie within the range of 0.05 to 0.50, and the higher the ratio, the higher the degree of extraction up to some value of the ratio where $98 \pm 2\%$ of the metal values are converted to sulfates. Further increases of the ratio do not adversely affect the sulfation, but require handling unnecessary amounts of molten salt. Higher roasting temperatures generally require larger amounts of salt within the range specified.

The nature of the salt bath must be chosen with the following considerations in mind. First, the function of the salt is to provide a gas permeable coating about the ore particles and a reaction environment in which both a high temperature, on the order of 650 to 800° C, and a high concentration of available $SO_3$ will be provided. NaCl, $Na_2SO_4$, KCl, $K_2SO_4$, and other salts are operable. However, the non-sulfate salts are rapidly converted to sulfates in the presence of $SO_2$ and oxygen. For example:

$$2NaCl + SO_2 + O_2 \rightarrow Na_2SO_4 + Cl_2$$

However, the addition of $Cl_2$ has no affect on the degree of copper and nickel extraction, indicating that the sulfate salts are the active extraction aid. Thus sulfate salts are preferred although other salts, e.g., halides, may be used if desired.

A mixture of salts is essential to the invention insofar as the melting point of a mixture is depressed in accordance with well-known melting point depression theory. Since a liquid coating on the ore particles is essential, it is important that the salt used have a melting point well below the roasting temperature. Copper and nickel sulfates produced during roasting of the mixture form a molten solution with the mixture of sodium and potassium sulfates to produce a copper and/or nickel sodium-potassium salt solution which is a liquid at the roast temperature.

A series of experiments has shown that a mixed salt is more efficient in extracting copper than any single salt and that the ratio of sodium to potassium is important for high nickel extraction. In the case of sulfates, changing the sodium to potassium ratio from 4 to 0.25 increased nickel extraction from 79% to 92% after a 120 minute roast. Copper extraction was not significantly affected by variations in the sodium-potassium ratio, but a separate set of experiments using only potassium sulfate in one and an equimolar sodium sulfatepotassium sulfate mixture in the other increased copper extraction from 87% in the former to 98% in the latter. The implication of these experiments is that while a copper sulfatepotassium sulfate mix does not form a low melting mixed salt, a copper sulfate-sodium sulfate-potassium sulfate system does, and will allow the required liquid coating to form. The melting point of sodium sulfate is 884° C and that of potassium sulfate is even higher, but the melting point of the salt mix useful in this invention is below 650° C, and typically should be well below this temperature, e.g., 500° C. When the sodiumpotassium sulfate salt mix is used, the operable sodiumpotassium ratio is within the range of 10 to 0.1, and the preferred range is 1.0 and 0.20. The best sodium-potassium ratio for a given concentrate must be determined specifically for that concentrate. When different salts are used, the best ratio for the mix should be determined.

To the molten mixture of concentrate and salt is added a roaster gas comprising oxygen and between 1% and 25%, preferably 1% to 5% sulfur dioxide. The gas should contain at least enough oxygen to allow the reactions involved to go to completion, but a gas containing far in excess of the stoichiometric amount of oxygen is also acceptable. In cases where the ore contains a large amount of sulfide, $SO_2$ is generated as a natural product of reaction with oxygen at the temperature of the roast and only minimal amounts of sulfur dioxide need be added to supplement that produced in the initial stages of the roasting. In any case, it is essential to maintain an $SO_2$ containing atmosphere over the reacting liquid-solid to prevent yield loss by $CuSO_4$ and $NiSO_4$ decomposition and subsequent ferrite formation. The above disclosed amount of $SO_2$ gas is designed to accomplish the above.

At the temperature of the roast, the oxygen and sulfur dioxide combine to form sulfur trioxide according to the equation:

$$\tfrac{1}{2}\,O_2 + SO_2 \rightleftarrows SO_3$$

It is believed that the sulfur trioxide thereby produced, being highly reactive, is the basic sulfating agent and that this agent acts either directly or through the formation of a pyrosulfate.

It is also important in the process of the present invention to assure that the ore particles, salt mix, and roaster gases are intimately mixed. On preferred method of mixing involves bubbling the gas through the ore-salt mixture during the roast, thereby providing continuous agitation of the reactants. In this circumstance, the mixed sulfate salts, when exposed to sulfur trioxide, are in part converted to pyrosulfates in accordance with the equation:

$$Na_2SO_4 + SO_3 \rightleftarrows Na_2S_2O_7$$

$$K_2SO_4 + SO_3 \rightleftarrows K_2S_2O_7$$

The presence of the molten salt coating on the solid particles acts to improve the rate and degree of metal extraction by providing an $SO_3$ rich environment in accordance with the above reactions. The pyrosulfates are capable of giving up $SO_3$ to sulfate the copper and nickel by acting as an $SO_3$ donating system. One other advantage of the pyrosulfate formation is that the pyrosulfates are capable of dissolving CuO, NiO, and copper, or nickel ferrites formed during the roast, e.g.:

$$CuO + S_2O_7^{=} \rightarrow CuSO_4 + SO_4^{=}$$

$$NiO + S_2O_7^{=} \rightarrow NiSO_4 + SO_4^{=}$$

$$CuFe_2O_4 + S_2O_7^{=} \rightarrow CuSO_4 + Fe_2O_3 + SO_4^{=}$$

$$NiFe_2O_4 + S_2O_7^{=} \rightarrow NiSO_4 + Fe_2O_3 + SO_4^{=}$$

The combined effect of pyrosulfate formation and the liquid salt coating is to make the roast process less sensitive to temperature variations and thus reduce the requirements of precise process control which characterizes conventional roasts. Furthermore, higher process temperatures result in the rejection of iron as $Fe_2O_3$ to a much greater degree than in conventional sulfation roasts, and since extracted Cu and Ni are present as a complex Ni-Cu-Na-K sulfate salt, the salts and metal values are water leached in about 30 minutes at 50° C, i.e., much faster than in conventional roast-leach processes.

The invention will be further understood from the following examples which should not in any way be construed as limiting.

EXAMPLE 1

3.316 grams of a concentrate containing 14.2% Cu as chalcopyrite and 2.5% Ni as pentlandite were placed in an alumina crucible with 1.005 g of an equimolar mixture of sodium sulfate and potassium sulfate and heated to 700° ± 5° C in a conventional laboratory furnace. Air was introduced to the reactor at a rate of 500 ml per minute. 25 ml per minute $SO_2$ was used to maintain the reaction atmosphere. After 120 min., the sample was removed, cooled to room temperature, and water leached. 95.0% of the nickel, 97% of the copper, and 1.8% of the iron was rended water soluble. The reactions taking place were as follows:

(1) $4CuFeS_2 + 13O_2 \rightarrow 4CuO + 2Fe_2O_3 + 8SO_2$ (2) $4NiFeS_2 + 13O_2 \rightarrow 4NiO + 2Fe_2O_3 + 8SO_2$ (3) $SO_2 + \tfrac{1}{2}\,O_2 \rightleftarrows SO_3$ (4) $Na_2SO_4 + SO_3 \rightleftarrows Na_2S_2O_7$ (5) $K_2SO_4 + SO_3 \rightleftarrows K_2S_2O_7$ (6) $CuO + SO_3 \rightarrow CuSO_4$ (7) $NiO + S_3 \rightarrow NiSO_4$ (8) $CuO + S_2O_7^{=} \rightarrow CuSO_4 + SO_4^{=}$ (9) $NiO + S_2O_7^{=} \rightarrow NiSO_4 + SO_4^{=}$

(10) $2Fe_2O_3 + 6SO_2 + 3O_2 \rightleftarrows 2Fe_2(SO_4)_3$

(11) $Fe_2O_3 + 3\ S_2O_7^{=} \rightleftarrows Fe_2(SO_4)_3 + 3SO_4^{=}$

(12) $Fe_2(SO_4)_3 \rightleftarrows Fe_2O_3 + 3SO_3$

Overall reactions:

(13) $4CuFeS_2 + 15O_2 \rightarrow 4CuSO_4 + 2Fe_2O_3 + 4SO_2$

(14) $4NiFeS_2 + 15O_2 \rightarrow 4NiSO_4 + 2Fe_2O_3 + 4SO_2$

The presence of $SO_3$ and the pyrosulfate push reactions 6-11 to the right and the temperature of the roast favors completion of reaction 12.

A separate series of experiments show that the sodiumpotassium ratio is important for high nickel extraction. The following examples are illustrative of these experiments.

EXAMPLE 2

An experiment was performed in accordance with Example 1 except that 0.80 grams of sodium sulfate and 0.20 grams of potassium sulfate were used in place of the equimolar mixture of Example 1. (Na/K=4). This treatment yielded over 98% of the copper to leachable form but only 79% of the nickel. In contrast, when the sodium-potassium ratio was changed to 0.25, i.e., 0.20 grams of sodium sulfate mixed with 0.80 grams of potassium sulfate, over 97% of the copper and 92% of the nickel was extracted.

A large number of experiments have been performed to establish the effect of various process parameters. For example, when sodium and potassium chlorides are used as salt additives, the chlorides are rapidly converted to sulfates with the release of chlorine in accordance with the equations:

(15) $2NaCl + SO_2 + O_2 \rightarrow Na_2SO_4 + Cl_2\uparrow$

(16) $2KCl + SO_2 + O_2 \rightarrow K_2SO_4 + Cl_2\uparrow$

EXAMPLES 3-7

A set of experiments was run to determine the effects of the sodium-potassium ratio and the use of $Cl_2$ gas on copper and nickel extraction in the process of the invention. Each experiment was conducted using a 2.000 g. sample of the concentrate of Example 1 with 0.300 g of sulfate salt added having the indicated Na/K mole ratio. The furnace temperature was 700° ± 5° C and the reaction atmosphere was maintained by a flow of 200 ml/min air and 10 ml/min $SO_2$. $Cl_2$ gas was added as indicated to simulate chloride salt reaction per reactions (15) and (16) above. All samples were treated for 120 minutes.

| | | | % Soluble Metal | | |
|---|---|---|---|---|---|
| Example | % $Cl_2$ | Na/K | Cu | Ni | Fe |
| 3 | 0 | 4.0 | 96 | 82 | 2.0 |
| 4 | 0.6 | 4.0 | 98 | 86 | 2.7 |
| 5 | 0 | 0.25 | 96 | 92 | 2.1 |
| 6 | 0.6 | 0.25 | 97 | 86 | 3.0 |
| 7 | 0.3 | 1.0 | 97 | 80 | 1.4 |

As can be seen from a study of these data, a low Na/K ratio results in higher nickel extraction. Since, of the two possible pyrosulfates, $K_2S_2O_7$ is the more stable, one might suspect that the improved result may be explained solely in terms of a pyrosulfate effect. If this suspicion were correct, pure $K_2SO_4$ would provide an extraction aid superior in performance to a mixture of $Na_2SO_4$ and $K_2SO_4$. However, since this hypothesis contradicts observation as evidenced by the following examples, it is apparent that the improvement in results may be traced to the combined effect of pyrosulfate formation and the formation of a liquid coating.

EXAMPLES 8 and 9

In these examples, 4.0 g of chalcopyrite concentrate, 1.0 g $FeS_2$, and 5.0 g of barren silicate rock were reacted with 1.5 g of salt for 120 minutes at 700° C in a rotating reactor. Reactor atmosphere was maintained by a gas flow of 500 ml/min air and 25 ml/min $SO_2$. The results disclosed below clearly indicate that only a mixture of salts capable of forming a low melting salt solution will act as an efficient extractant.

| | | % Soluble Metal | |
|---|---|---|---|
| Example | Salt | Cu | Fe |
| 8 | equimolar $Na_2SO_4$-$K_2SO_4$ | 98 | 3.3 |
| 9 | $K_2SO_4$ | 87 | 3.3 |

Experience indicates that when copper extraction is incomplete, nickel extraction is even more incomplete.

An examination of the phase diagrams of $Na_2SO_4$—$CuSO_4$, $K_2SO_4$—$CuSO_4$, and $Na_2SO_4$—$K_2SO_4$—$CuSO_4$, as disclosed in the published literature, (e.g. Phase Diagrams for Ceramists, E. M. Levin, C. R. Robbins, and H. F. McMurdie, ed., American Ceramic Society, Columbus, Ohio, 1969) shows that a salt mixture is required to lower the melting point of the salt solution to a temperature substantially below that used in the roast process. Of course, other salt combinations which fulfill the dual requirement of low melting point and pyrosulfate forming ability will be obvious to those skilled in the art in view of this specification. Combinations including halide salts are one non-limiting example of such equivalent extraction aids.

EXAMPLES 10 AND 11

1.32 g of the concentration used in Example 1 were roasted with varying amounts of a salt mixture comprising 50% by weight of equimolar NaCl-KCl and 50% by weight $Na_2SO_4$. The roast was conducted for 120 minutes at a temperature of 700° ± 5° C. while maintaining a reactor atmosphere with a gas flow of 500 ml/min air and 25 ml/min $SO_2$. The results of these experiments are indicated below.

| | | % Soluble Metal | | |
|---|---|---|---|---|
| Examples | Wt. Salt Mixture | Cu | Ni | Fe |
| 10 | 0.13 g | 97 | 99 | 4.0 |
| 11 | 0.66 g | 98 | 100 | 3.2 |

EXAMPLES 12-15

Additional experiments (12, 13, 14) were conducted in the manner of Examples 10-11, except that larger amounts of concentrate and salt were used so as to impede the flow of gas to the bulk of the concentrate particles and their liquid coatings. These experiments were designed to show that intimate mixing of all three phases, gas, solid, and liquid, is needed to achieve the desired results. For purposes of comparison, Example 15 was conducted using a procedure identical to that of Examples 12, 13, and 14, except that a slowly rotating reactor was used so that gas-liquid-solid mixing was achieved. The results of these experiments are indicated in the table below.

| Example | Wt. Salt | Wt. Conc. | % Soluble Metal | | |
|---|---|---|---|---|---|
| | | | Cu | Ni | Fe |
| 12 | .99g | 3.30g | 97 | 97 | 3.5 |
| 13 | .53g | 5.28g | 90 | 63 | 1.4 |
| 14 | 2.64g | 5.28g | 90 | 86 | 1.7 |
| 15 | 2.00g | 10.00g | 100 | — | 3.1 |

EXAMPLE 16

A principal advantage of using the process chemistry described herein is that reaction time is considerably shorter than in conventional roasting processes. To illustrate this phenomenon, a series of samples were prepared in 15 mm × 25 mm alumina boats. The samples each contained 0.375 g of the concentrate used in Example 1 and 0.125 g of alkali sulfate salt with a Na/K = 0.21. A specially designed reactor was prepared so that a series of samples could be introduced to the hot zone without disturbing the reactor atmosphere or temperature. The former was maintained by a flow of 950 ml/min air and 50 ml/min $SO_2$. The latter was kept at 725° ± 5° C. Extractions as a function of residence time, shown below, indicate essentially complete copper extraction in 20 minutes and complete nickel extraction in 40 minutes.

| Time (min.) | % Soluble Metal | | |
|---|---|---|---|
| | Cu | Ni | Fe* |
| 20 | 94 | 72 | 10 |
| 40 | 100 | 93 | 11 |
| 60 | 97 | 89 | 11 |
| 80 | 98 | 89 | 7 |
| 100 | 99 | 89 | 5 |

In contrast, conventional sulfation roasts involve roasting times up to 6 hours for Ni extractions which generally do not exceed 85%. See, for example, U.S. Pat. No. 2,719,082 (87% Ni extraction in 3 hours) and U.S. Pat. No. 2,556,215 (89% Ni extraction in 48 hours).

EXAMPLE 17

In another series of experiments, the procedure of Example 1 was repeated except that the ratio of salt to concentrate was varied between 0.05 and 0.50 instead of being maintained at 0.30. It was found that variations in the salt to concentrate ratio affected the extraction of nickel more than the extraction of copper. The higher the ratio, the higher the degree of extraction up to some value of the ratio. This value is within the range recited and is characterized by a conversion of 98 ± 2% of the non-ferrous metal values to sulfates, but varies slightly for different ores. The preferred range for this ratio is 0.1 to 0.25. Further increase in the ratio above about 0.50 does not affect the sulfation but does increase cost because of the necessity of handling increased amounts of molten salt.

EXAMPLE 18

So called "hot spotting" invariably occurs in the course of sulfation roasting on a commercial scale. When hot spotting ocurrs, local temperatures rise considerably and result in the formation of water insoluble ferrites as per the following reactions:

$$(17)\ CuSO_4 \xrightarrow[\Delta H]{} CuO + SO_3$$

$$(18)\ Fe_2O_3 + CuO \longrightarrow CuFe_2O_4$$

$$(19)\ NiSO_4 \xrightarrow[\Delta H]{} NiO + SO_3$$

$$(20)\ NiO + Fe_2O_3 \longrightarrow NiFe_2O_4$$

To illustrate that the chemistry of the process of this invention is capable of overcoming the effects of hot-spotting, experiments were conducted in the manner of Example 16, except that pure $NiFe_2O_4$ and $CuFe_2O_4$ were placed in the reaction trays instead of the concentrate. There ferrites were roasted at 722° ± 2° C. in an atmosphere of 4.0% $SO_2$ in air. After 60 minutes, 92% of the copper had been extracted from the copper ferrite and, in a separate experiment, 42% of the nickel had been extracted from the nickel ferrite. The extraction was incomplete in the latter case because the melting point of the $Na_2SO_4$—$K_2SO_4$—$NiSO_4$ salt solution formed increased to a temperature above that used in the roast and thus terminated the reaction.

EXAMPLE 19

A series of 46 experiments were conducted using the procedure of Example 16 and a conventional chalcopyrite concentrate having a composition of 25% Cu, 25% Fe, and 29% S. Operational parameters were varied as followed:

Temperature: 650°–800° C.
% $SO_2$: 1.0%–10%
% Salt: 5%–25%
Time: 10–120 min.

Figure 2:
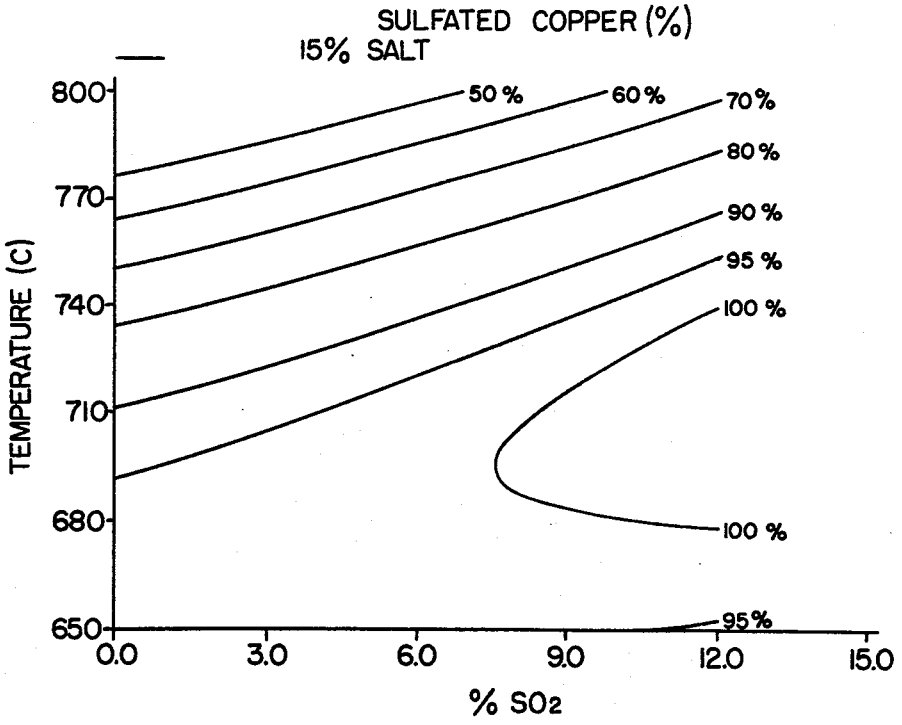
FIG. 2 is a graph showing the results of a series of roasts conducted in accordance with the present invention.

The data obtained from these experiments were subjected to a multiple linear regression analysis on a computer. Equations were generated to reflect the extraction of Cu as a function of the operating parameters and these equations were plotted. FIG. 1 shows a series of computer generated curves of temperature versus % $SO_2$ used for a series of sulfations using no salt (results taken after 40 minute roast). FIG. 2 is a computer generated series of curves calculated from results taken under identical process conditions except that 15% salt was included. These results clearly show a greatly increased range of operating parameters over which 95% or higher copper extractions are achieved. Translated into commercial operations, these curves demonstrate that a greatly reduced degree of process control is required using the process of the invention while nevertheless maintaining economically attractive copper recovery in relatively short periods of time.

It has been observed that higher process temperatures and leaner ore concentrates require larger amounts of added salt. This behavior is consistent with the suggested mechanism whereby liquid salt coats the concentrate particles and pyrosulfates are formed. Because of this observation, it is believed that the pyrosulfates are mainly responsible for supplying the $SO_3$ activity which sulfates the metal values and stabilizes the copper and nickel sulfates formed. The following example illustrates this phenomenon.

EXAMPLE 20

A salt bath consisting of 21 grams $Na_2SO_4$ and 79 grams NaCl was heated in an electric furnace to 820° ± 5° C. After the salt has melted and come up to temperature, 5.0 grams of preroasted chalcopyrite ($CuFeS_2$) was added to the salt. The preroasting converts the chalcopyrite to cupric and iron oxides as per equations 1, 17, and 18. The melt is stirred by bubbling gas consisting of 1500 ml per minute air plus 7.5 ml per minute $SO_2$ through the melt using a single hole 6 mm outside diameter quartz tube. Thirty minutes after the start of gas bubbling, the melt was sampled and analyzed for water soluble copper and water soluble iron. Then 5.0 grams more of preroasted chalcopyrite were added to the melt. The process was continued until a total of 30.0 grams of concentrate had been added. The table below summarizes the results of this experiment.

Table

| Time | Conc. added | Sol. Cu | Sol. Fe |
|---|---|---|---|
| 0 min. | 5.0 g | — | — |
| 30 | 5.0 | 1.04 g | 0.03 g |
| 60 | 5.0 | 2.40 | 0.03 |
| 90 | 5.0 | 3.82 | 0.03 |
| 120 | 5.0 | 5.61 | 0.05 |
| 150 | 5.0 | 7.32 | 0.04 |
| 210 | — | 9.43 | 0.02 |

The theoretical maximum soluble Cu was 9.55 g and, as can be seen from the Table, since 9.43 g are successfully extracted, 98.7% of the total soluble copper was recovered. The copper-iron partition was 487:1. This example indicates that higher temperatures than those disclosed in the preceeding examples may be employed if additional amounts of salt are used. Note that the salt to concentrate ratio in this example was 3.33. While such modifications of the selective sulfation process are within the scope of the invention, it is highly preferable to keep the amount of salt used at a minimum so as to avoid the neccesity of handling unduly large quantities of molten salt.

In addition, this example indicates that salts other than sulfates are useable, although, as indicated above, such salts are rapidly converted to sulfates in the $SO_2$ atmosphere. After conversion of the NaCl to $Na_2SO_4$ (a reaction which goes essentially to completion if the chlorine produced is removed) the roast takes place in $Na_2SO_4$ only. Obviously, since the melting point of $Na_2SO_4$ is 884° C., the $Na_2SO_4$ mixed with the copper sulfates produced to form a mixed salt having a melting point below the temperature of the roast (820° C.). The presence of the chloride-sulfate mixture in the initial stages of the roast accounts for the salt melting below 820° C.

At the end of the process of this invention, the non-ferrous sulfates may be separated from the $Fe_2O_3$, and other insoluble substances such as plagioclase, olivine, pyroxene, and ilmenite which are often found in the types of ore described above. In this regard, it is contemplated that conventional separation techniques may be employed. To take advantage of the process, a separation technique based on the solubility difference between the $Fe_2O_3$ and non-ferrous metal sulfates should be used, e.g., a water leach.

More specifically, the solution of molten salt and copper and/or nickel sulfates, which at the end of the roast coat the $Fe_2O_3$ and any gangue solids, should be removed from the kiln while at a temperature above its melting point (typically approximately 500° C.). Water quenching at this temperature effectively separates the insoluble iron oxides from the non-ferrous metal sulfates and yields a concentrated solution of the non-ferrous metal values. Solubility product constants and pure salt solubility for some salts are given below.

| Salt | Pure Salt Solubility g/100 ml 0° | 100° | $K_{sp}$ at 25° C |
|---|---|---|---|
| $K_2SO_4$ | 10 | 24 | $2.7 \times 10^{-3}$ |
| $Na_2SO_4$ | 48 | 42 | $2.7 \times 10^{-2}$ |
| $CuSO_4$ | 14 | 75 | .22 |
| $NiSO_4$ | 29 | 83 | .54 |

The metal values in the concentrated sulfate solution can be recovered by a wide selection of process configurations e.g., electrowinning. Any recovery process chosen, by necessity, will involve reduction.

Figure 3:
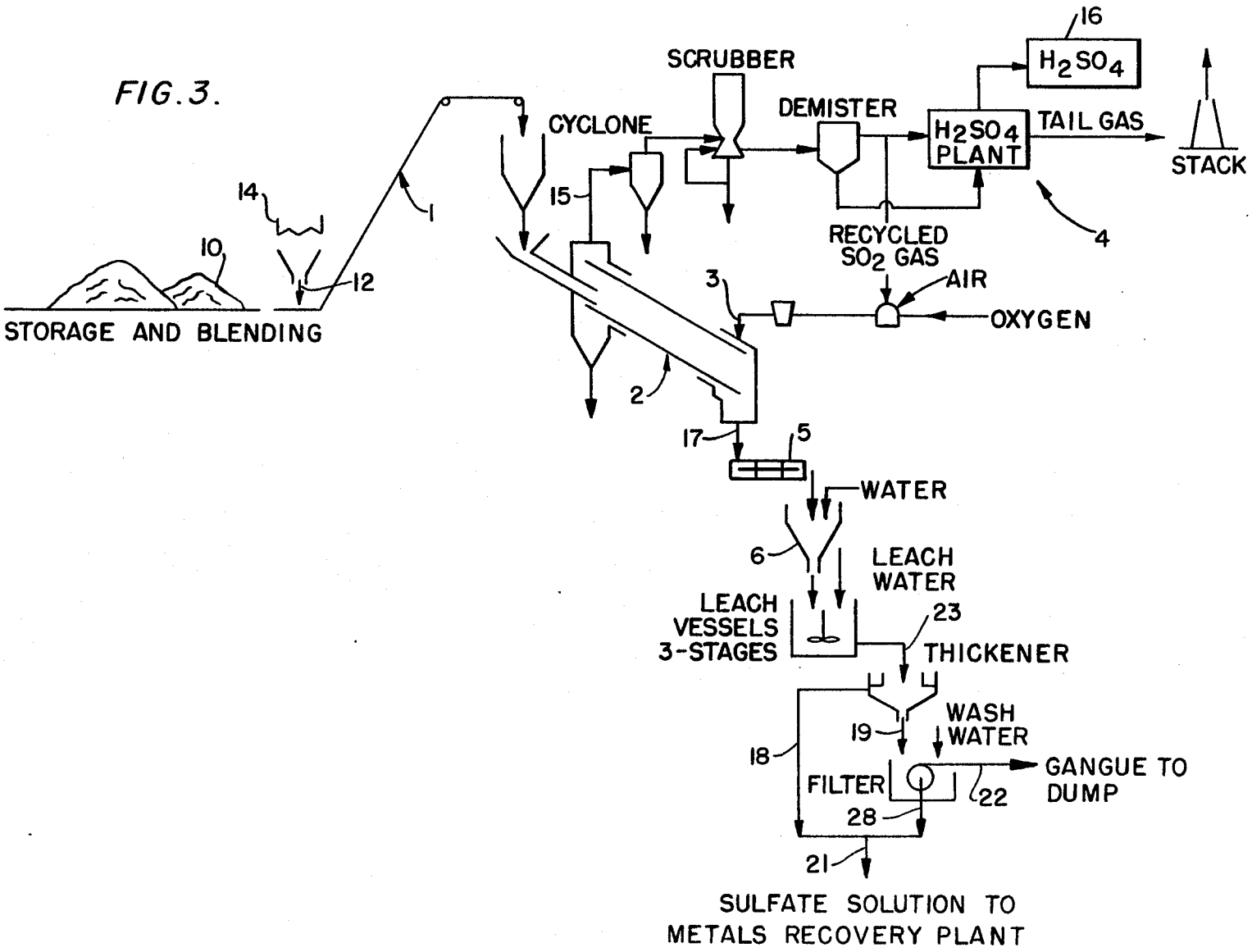
FIG. 3 is a flow diagram schematically illustrating a commercial process embodying the invention.

Referring to FIG. 3, a schematic diagram illustrating an exemplary commercial process is shown. Copper or nickel bearing sulfide concentrate 10 is fed to a conveyor 1. A salt mixture 12 is added to the conveyor from a hopper 14. The resulting mixture is fed to kiln roaster 2 together with $SO_2$ gas and air (or oxygen as desired) which may conveniently be obtained from the output 3 of an off gas reclamation and treatment system 4. It should be noted that a fluid bed reactor (not shown) or other suitable roasting apparatus may be substituted for kiln roaster 2 as desired. When the concentrate, as described, is a sulfide ore, and the roasting is performed in a fluid bed roaster, no external source of $SO_2$ need be supplied to the fluid bed roaster.

The roasted ore is collected at 5, water quenched in quench tank 6, and the metal values of interest are leached in, e.g., a 3 stage leach system. Thereafter, the leach liquor is thickened and filtered to remove gangue solids. The thickened pregnant liquor may thereafter be treated to recover the metal values employing conventional techniques, e.g., liquid ion.

The material balances for the process illustrated in FIG. 3 appears below. The composition of concentrate 10 is:

18% Cu & Ni
23% S
24% Fe
25% gangue

It should be noted that the material balances which follow can be used to treat a concentrate containing 0–18% copper and 0–18% nickel. However, the total of the copper and nickel for the material balances given is 18% by weight.

In the table below, the numbers to the left correspond to the reference numerals of FIG. 3.

| | | |
|---|---|---|
| (1) | Concentrate | 900 TPD |
| | Sodium Sulfate | 90 TPD |
| | Potassium Sulfate | 45 TPD |
| | Total | 1035 TPD |
| (15) | Roaster off gases 40,000 SCF at 1300°F | |
| (16) | Sulfuric Acid 380 TPD | |
| (17) | Calcine at 1300°F 1160 TPD | |
| (23) | Leach Slurry | 2730 TPD |
| | Solids | 630 TPD |
| | Liquid | 2100 TPD |
| (18) | Thickener Overflow 1470 TPD liquid | |
| (19) | Thickener Underflow 1260 TPD solids slurry | |

-continued

| | |
|---|---|
| | (50% solids) |
| 20) | Filtrate from filter |
| | 625 TPD Liquid |
| 21) | Total leach liquor |
| | 2095 TPD |
| | 90 gpl Cu |
| 22) | Gangue to dump 905 TPD |
| | Dry analysis 47.6% $Fe_2O_3$ |

The invention may be embodied in other specific forms without departing from the spirit or essential characteristics thereof. The present embodiment is therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A process for separating non-ferrous metal values from ferrous metal values in an ore containing iron and at least one metal selected from the group consisting of copper, nickel cobalt, vanadium, and manganese, said process comprising the steps of:

mixing the ore, in particulate sulfide form, with a mixture of inorganic salts, which mixture has a melting point below the roasting temperature of the ore the ratio of salt mixture to ore being at least 0.05;

heating the ore and salt mixture to melt the salt mixture and to form a liquid salt coating on the ore;

contacting the ore coated with the liquid salt coating with a roaster gas comprising at least 1% $SO_2$ and $O_2$, the amount of $O_2$ being sufficient to convert non-ferrous metals to sulfates and the ferrous metals to $Fe_2O_3$, said contacting being conducted at a temperature above 650° C. and for a sufficient amount of time to produce non-ferrous metal sulfates and iron oxide; and separating the non-ferrous metal sulfates from the iron oxide.

2. The process as set forth in claim 1 wherein the roaster gas comprises 1% to 25% $SO_2$.

3. The process as set forth in claim 1 wherein the roaster gas comprises 1% to 5% $SO_2$.

4. The process as set forth in claim 1 wherein the mixture of inorganic slats has a melting point below 650° C.

5. The process as set forth in claim 1 wherein the salt mixture comprises a mixture of sodium and potassium sulfates.

6. the process as set forth in claim 5 wherein the sodium sulfate-potassium sulfate mole ratio is between 10 and 0.1.

7. The process as set forth in claim 5 wherein the sodium sulfate-potassium sulfate mole ratio is between 1.0 and 0.20.

8. The process as set forth in claim 1 wherein the ratio of salt mixture to ore is between 0.05 and 10.0.

9. The process as set forth in claim 1 wherein the ratio of salt mixture to ore is between 0.1 and 0.25.

10. The process as set forth in claim 1 wherein the salt mixture has a melting point below 650° C. and the ore is heated to a temperature within the range of 650° C. and 800° C.

11. The process as set forth in claim 10 wherein the ore is heated to a temperature within the range of 675° C. and 750° C.

12. The process as set forth in claim 1 wherein the ore contains at least one metal selected from the group consisting of copper and nickel.

13. The process as set forth in claim 1 wherein the ore and liquid salt mixture is contacted with a stoichiometric excess of $O_2$.

14. The process as set forth in claim 1 wherein the ore, coated with the liquid salt coating, is contacted with a roaster gas by bubbling the roaster gas through the ore - liquid salt mixture.

15. A process for partitioning non-ferrous metal values from ferrous metal values in an ore containing iron and at least one non-ferrous metal value selected from the group consisting of copper, nickel cobalt, vanadium, and manganese by selective sulfation of the non-ferrous metal values to render the non-ferrous metal values water leachable, wherein the improvement comprises:

coating ore particles in sulfide form with a mixture of molten sodium and potassium salts; and reacting the coated particles, at a temperature between 650° C. and 800° C., with a roaster gas comprising at least 1% $SO_2$ and at least a stoichiometric equivalent of $O_2$ to produce $Fe_2O_3$ and a molten solution of salts which includes at least one non-ferrous metal ion selected from the group consisting of copper, nickel, cobalt, vanadium, and manganese ions.

16. The improved process as set forth in claim 15 wherein the non-ferrous metal values partitioned are selected from the group consisting of copper and nickel.

17. The improved process as set forth in claim 16 wherein the ore particles are coated with a mixture of molten potassium and sodium sulfate.

18. The improved process as set forth in claim 17 wherein the sodium sulfate-potassium sulfate mole ratio of the molten sodium and potassium salt mixture is between 10 and 0.1.

19. The improved process as set forth in claim 17 wherein the sodium sulfate-potassium sulfate mole ratio of the molten sodium and potassium salt mixture is between 1.0 and 0.20.

20. The improved process as set forth in claim 16 wherein the roaster gas comprises between 1% and 25% by volume $SO_2$.

21. The improved process as set forth in claim 16 wherein the roaster gas comprises between 1% and 5% $SO_2$.

22. The improved process as set forth in claim 16 including the further step of separating the $Fe_2O_3$ from the sulfate salt which includes a non-ferrous metal ion by utilizing the solubility difference between $Fe_2O_3$ and the non-ferrous metal sulfate in aqueous solution.

23. A Process for separating metal values selected from the group consisting of copper and nickel from iron in a finely divided sulfide concentrate comprising the steps of:

(A) contacting the sulfide concentrate, at a temperature above 650° C., with a sufficient amount of a molten mixture of inorganic salts having a melting point below 650° C. to form a liquid salt coating on particles of the ore;

(B) contacting the concentrate coated with the liquid salt coating with a roaster gas comprising oxygen and sulfur trioxide to form molten sulfates including a non-ferrous metal ion selected from the group consisting of copper and nickel and to form iron oxide; and (C) water leaching the sulfate salts produced in step B to solubilize the non-ferrous metal ions.

24. The process as set forth in claim 23 wherein the molten mixture of inorganic salts comprises a molten mixture of sodium and potassium sulfates and pyrosulfates are produced during said process.

25. The process as set forth in claim 24 wherein the concentrate contains copper values and wherein the molten mixture of sodium and potassium sulfates comprises a mixture having a mole ratio of sodium sulfate to potassium sulfate between 10 and 0.10.

26. The process as set forth in claim 24 wherein the concentrate contains nickel values and wherein the molten mixture of sodium and potassium sulfates comprises a mixture of sodium sulfate and potassium sulfate having a mole ratio of sodium sulfate to potassium sulfate between 1.0 and 0.20.

27. The process as set forth in claim 23 further comprising the step of recovering the non-ferrous metal values from the water leach solution of non-ferrous metal ions produced in step C.

28. The process as set forth in claim 23 further comprising the step of reducing the copper or nickel ion component of the leached sulfate salt to recover at least one metal selected from the group consisting of copper and nickel.

* * * * *